United States Patent [19]

Houck

[11] 4,429,763

[45] Feb. 7, 1984

[54] BUCKET ROTATION SYSTEM FOR AERIAL TOWER

[75] Inventor: Timothy B. Houck, Raleigh, N.C.

[73] Assignee: Technical and Safety Consultants, Inc., Raleigh, N.C.

[21] Appl. No.: 354,657

[22] Filed: Mar. 4, 1982

[51] Int. Cl.[3] ..... B66F 11/04

[52] U.S. Cl. ..... 182/2

[58] Field of Search ..... 182/2

[56] References Cited

U.S. PATENT DOCUMENTS

| | | | |
|---|---|---|---|
| 3,590,948 | 7/1971 | Milner | 182/2 |
| 3,828,941 | 8/1974 | Coutinho | 182/2 |
| 4,081,055 | 3/1978 | Johnson | 182/2 |

*Primary Examiner*—Reinaldo P. Machado
*Assistant Examiner*—Alvin Chin-Shue
*Attorney, Agent, or Firm*—Bell, Seltzer, Park & Gibson

[57] ABSTRACT

The present bucket rotation system can be easily and quickly interposed in the conventional mechanical bucket leveling system of an aerial tower and may be operated to immediately move the bucket from the normal vertical position to a horizontal position to facilitate removal of an injured workman, and/or to facilitate cleaning of the bucket. Hydraulic cylinders are interposed in the mechanical bucket leveling system and their operation imparts movement to the leveling system to rotate the bucket independently of movement of the boom sections.

4 Claims, 3 Drawing Figures

BUCKET ROTATION SYSTEM FOR AERIAL TOWER

FIELD OF THE INVENTION

This invention relates generally to a bucket rotation system for an aerial tower and more particularly to such a system which permits rotation of the workman support bucket from the normal vertical position to a horizontal position to facilitate the removal of an injured workman and to facilitate cleaning and maintenance of the support bucket.

BACKGROUND OF THE INVENTION

It is the common practice for public utilities and similar companies to use service and maintenance trucks provided with some type of boom structure supporting a workman support bucket or basket at the outer end thereof. These structures are usually referred to as "aerial towers" and are particularly useful in servicing electric power and telephone lines, overhead traffic lights, street lamps and the like, and these structures are provided with some type of leveling mechanism to maintain the workman support bucket in a vertical position during all of the various adjustable positions of the boom structure.

Many of these aerial towers employ a mechanical leveling system to maintain the workman support bucket in a vertical position. These mechanical leveling systems usually employ one or more closed loops of flexible elongate material, such as cables, sprocket chains or other link and lever systems. In the event a workman in the bucket is injured and needs to be removed immediately, it is the common practice to lower the bucket to a position as close to the ground as possible and remove the workman therefrom, while the bucket is still in a vertical position. This can be a cumbersome and time-consuming operation and may delay treatment of the workman under circumstances where the delay of treatment, even for a few minutes, can be fatal.

It is also known to provide a bucket leveling system which includes a pendulum-operated control valve to regulate hydraulic fluid supply to a leveling motor. Such a leveling system is disclosed in U.S. Pat. No. 3,590,948 and this patent also discloses a manually operated bypass valve which may be used to override the normal pendulum-operated leveling control valve to tilt or rotate the bucket to a horizontal position for facilitating the removal of an injured workman. This pendulum-operated leveling system includes a gravity-sensing weight supported on the lower end of a rod which is fixed at its upper end to a control valve adapted to control the flow of hydraulic fluid to a leveling fluid motor. This gravity-sensing weight is supported on the workman support bucket and is subject to being engaged by limbs and the like, particularly when working with the aerial tower in trees and the like, and the support rod may become bent or jammed to provide positioning of the bucket at other than the desired vertical position.

SUMMARY OF THE INVENTION

With the foregoing in mind, it is an object of the present invention to provide a bucket rotation system which may be easily and quickly interposed in the conventional mechanical leveling system of an aerial tower and which may be operated to immediately move the support bucket from the normal vertical position to a horizontal position to facilitate removal of an injured workman, and to facilitate cleaning of the bucket.

In accordance with the present invention, the mechanical bucket leveling system of the aerial tower includes one or more closed loops of flexible elongate material extending along the first and second boom sections. The closed loop is attached to the bucket and normally operates with movement of the boom sections to maintain the workman support bucket in a vertical position. The present bucket rotation system includes operator means interposed in the closed loop for imparting movement in opposite directions to adjacent runs at one end of the closed loop, independently of movement of the boom sections, to move the workman support bucket from the normal vertical position to a horizontal position. The operator means is illustrated as including a first hydraulic cylinder interposed in one run and in a normally inactive extended position and a second hydraulic cylinder interposed in the other run and in a normally inactive contracted position. Hydraulic control means, illustrated as a manually controlled valve, is provided for reversing the positions of the first and second hydraulic cylinders and for moving the same to active positions so that the first hydraulic cylinder occupies an increased effective length of its run while the second hydraulic cylinder occupies a decreased effective length of its run. This action imparts movement in opposite directions to the portions of the adjacent runs at one end of the closed loop and immediately rotates the bucket to the horizontal position, independently of movement of the boom sections.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
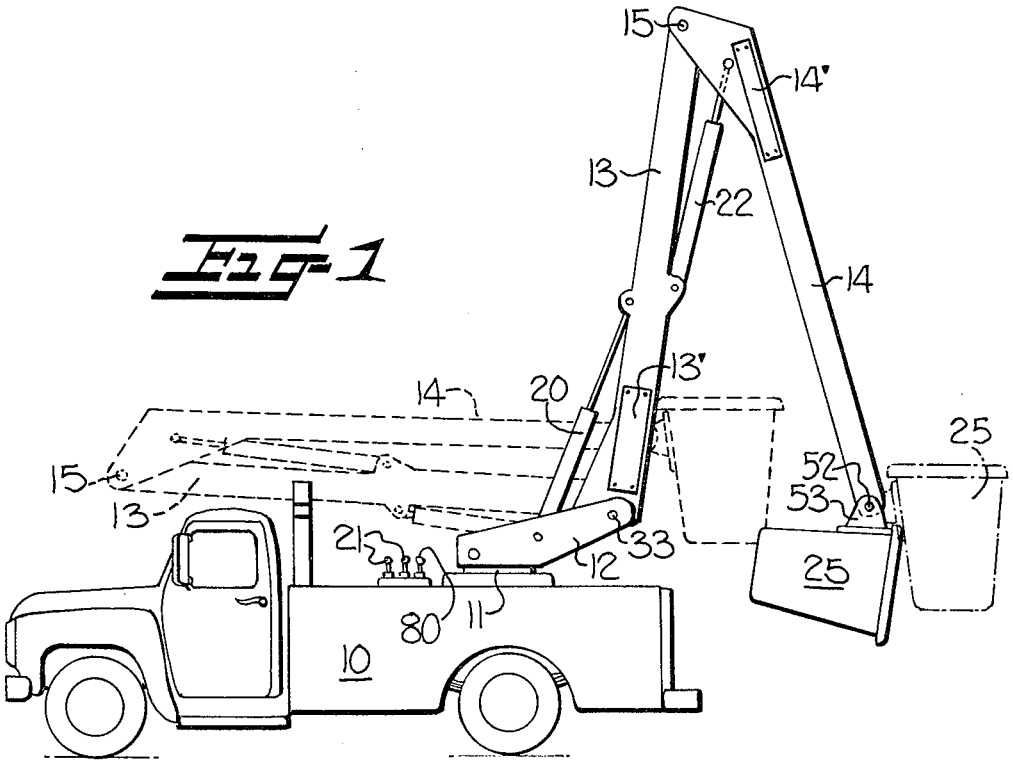
FIG. 1 is a side elevational view of a truck equipped with an aerial tower and illustrating various positions of the boom sections and workman bucket.

A mobile aerial tower type utility maintenance truck 10 is shown in FIG. 1 and the body of the truck is provided with the usual type of turntable 11 which supports a boom platform 12. A boom is supported on the platform 12 and includes a first or lower boom section 13 pivotally supported at its lower end on the boom platform 12. A second or upper boom section 14 is pivotally supported at its lower end to the upper end of the first boom section 13, as by a pivot shaft 15.

Motive means, in the form of a hydraulic cylinder 20, is provided for imparting selected movement to the first boom section 13 relative to the boom platform 12 and the truck 10. Control levers 21 are illustrated as being mounted on the truck body for operating the various movements of the boom sections and the bucket, in a manner to be presently described. Motive means, in the form of a hydraulic cylinder 22, is provided for imparting selected movement to the second boom section 14, relative to the first boom section 13. A workman support bucket 25 is supported for pivotal movement on the outer end of the second boom section 14 and is normally maintained in an upright or level vertical position (shown in dotted and dash-dot lines in FIG. 1) throughout all movements of the boom sections 13, 14.

The mechanical leveling system extends from the truck 10 to the workman support bucket 25 and includes (FIG. 2) first and second closed loops of flexible elongate material, broadly indicated at 26 and 27, and extending along the respective first and second boom sections 13, 14. The closed loops 26, 27 include adjacent runs which normally move in opposite directions upon movement of the boom sections 13, 14 to normally maintain the bucket 25 in a level vertical position. The first closed loop 26 includes a sprocket chain section 30 at the inner end of the boom section 13. The sprocket chain section 30 extends over an idler sprocket 31, a sprocket 32 supported in a fixed position on a fixed pivot shaft 33, and an idler sprocket 34. Opposite ends of the sprocket chain 30 are connected, through hydraulic cylinders to be presently described, to length adjustment connectors 35, 36 which are in turn connected to one end of control cables 37, 38. The control cable 37 is illustrated as being guided by pulleys 39 mounted in the first boom section 13. Opposite ends of the control cables 37, 38 are suitably connected to opposite ends of a sprocket chain section 40 at the outer or upper end of the boom section 13. The medial portion of the sprocket chain section 40 engages and is supported on a sprocket fixed on a pivot shaft 15 and immediately behind a mating sprocket 41.

The closed loop 27 includes a sprocket chain section 42 which engages the sprocket 41 and passes over idler sprockets 43, 44 and opposite ends are provided with length adjustment connectors 45, 46. The length adjustment connectors 45, 46 are suitably connected to the ends of control cables 47, 48 which pass along the second boom section 14. The ends of the control cables 47, 48 are suitably connected to opposite ends of a sprocket chain section 50, the medial portion of which engages and passes around a sprocket 51, fixed on a pivot shaft 52. Opposite ends of the pivot shaft 52 are fixed to a bucket support bracket 53 so that any rotational movement imparted to the sprocket 51 is transmitted to the bucket 25.

Figure 2:
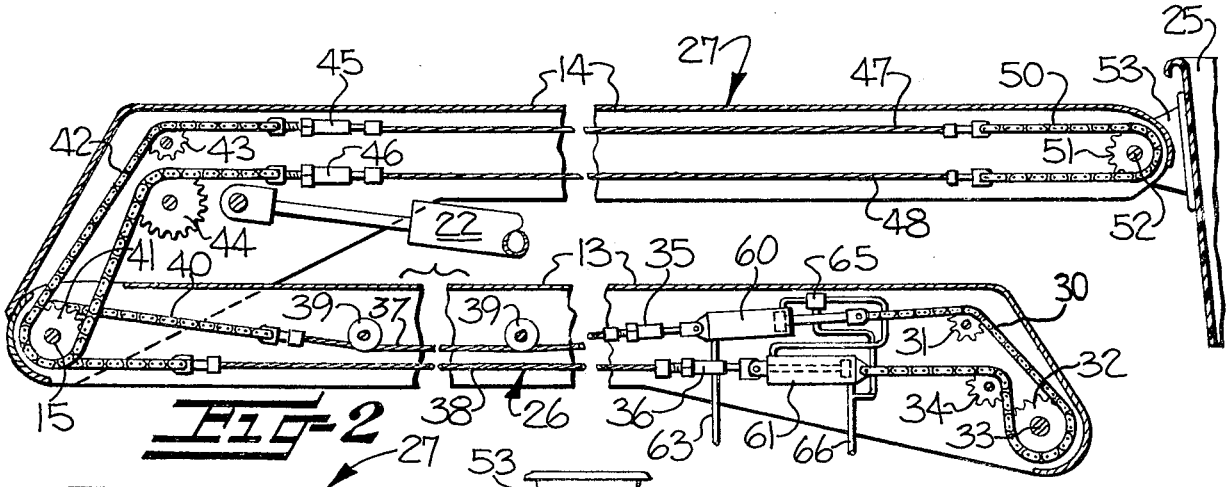
FIG. 2 is a longitudinal vertical sectional view through the aerial boom and illustrating the mechanical leveling system with the present bucket rotation system interposed therein.

The length adjustment links 35, 36 in the lower boom section 13 and 45, 46 in the upper boom section 14 are provided to maintain the closed loops 26 and 27 in a taut condition and to also adjust the level of the bucket 25 so that it is in a vertical position when the boom section is at rest, as when in the stored position shown in FIG. 2 and in dotted lines in FIG. 1. Access plates 13', 14' (FIG. 1) are provided on the respective boom sections so that the length adjustment connectors can be easily adjusted. When the boom sections 13 and/or 14 are moved from the stored position, the mechanical leveling system operates in response to movement of the boom sections 13 and/or 14 and the adjacent runs of the closed loops 26, 27 move in opposite directions so that the bucket 25 is maintained in a vertical or level position throughout the range of movement of the boom sections.

Figure 3:
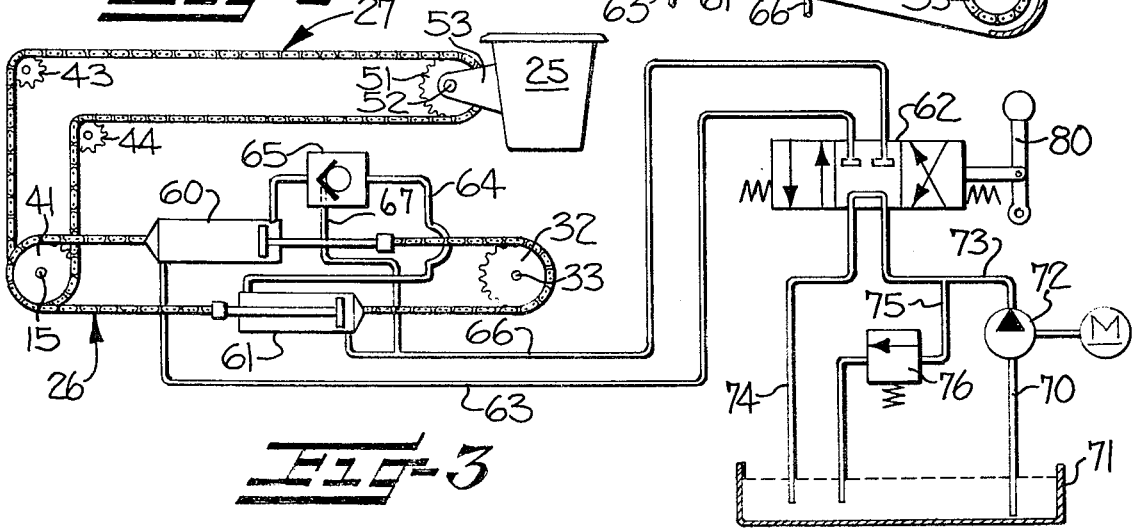
FIG. 3 is a somewhat schematic diagram illustrating the manner in which the hydraulic cylinders of the bucket rotating system are interposed in the mechanical leveling system and the manner in which the cylinders are operated by the hydraulic system.

The bucket rotation system of the present invention includes operator means interposed in at least one of the closed loops 26, 27 of the mechanical leveling system. As illustrated in FIGS. 2 and 3, the operator means includes a first hydraulic cylinder 60 interposed in one run of the closed loop 26 and in a normally inactive extended position. A second hydraulic cylinder 61 is interposed in the other run and in a normally inactive contracted position. When the positions of the hydraulic cylinders 60, 61 are reversed and moved to active positions, in a manner to be presently described, movement in opposite directions is imparted to the adjacent runs of the left-hand portion of the closed loop 26 and independently of movement of the boom sections 13, 14 to impart movement to the closed loop 27 and thereby move the bucket 25 from the vertical to the horizontal position.

As illustrated in FIG. 3, the hydraulic cylinder 60 is connected at one end to a three-way control valve 62, by a hydraulic supply line 63. The other end of the hydraulic cylinder 60 is connected to one end of the hydraulic cylinder 61 by a hydraulic line 64 which includes a check valve 65. The other side of the hydraulic cylinder 61 is connected to the valve 62 by a hydraulic line 66. A line 67 is connected between the line 66 and the check valve 65 so that the bucket 25 will remain in position should the hydraulic pressure line break.

A line 70 is connected at one end to a hydraulic supply tank 71 and its other end is connected to a hydraulic pump 72. A line 73 connects the pump 72 to the three-way valve 62. A hydraulic return line 74 is connected at one end to the three-way valve 62 and its other end extends into the supply tank 71. A relief valve line 75 is connected between the line 73 and the tank 71 and includes a pressure relief valve 76 which directs hydraulic fluid back to the supply tank 71, should the pressure in the system exceed a predetermined amount. A manually operated control lever 80 is provided to operate the control valve 62 and is normally mounted with the other controls 21.

With the parts in the condition shown in FIG. 3, the hydraulic cylinder 60 is normally maintained in the inactive extended position while the hydraulic cylinder 61 is normally maintained in the inactive contracted position, as long as the three-way valve 62 remains in the neutral position. In this condition, any movement imparted to the boom sections 13 and/or 14 is transmitted through the closed loops 26, 27 to the bucket sprocket 51 so that the bucket 25 is maintained in a vertical position as movement is imparted to either or both of the boom sections.

If it should become necessary to move the bucket 25 from the vertical to the horizontal position, such as to remove an injured workman, or to clean the bucket, the boom sections 13, 14 will be moved to the position shown in solid lines in FIG. 1 so that the bucket 25 is located in a position adjacent the ground and the bucket 25 will be brought to this position in a vertical position, as shown in dash-dot lines in FIG. 1. The three-way valve 62 will then be moved by the control lever 80 and shifted to the right from the position shown in FIG. 3 so that the hydraulic pump 72 feeds fluid under pressure into the line 66 and into the right-hand end of the hydraulic cylinder 61 to move the piston therein to the left and to an active extended position. This causes the cylinder 61 to occupy an increased effective length in its run. Hydraulic fluid is forced out of the left-hand end of the cylinder 61 and through line 64 and check valve 65 and into the right-hand end of the cylinder 60 to cause the piston therein to move to an active contracted position. This causes the cylinder 60 to occupy decreased effective length in its run.

The hydraulic fluid in the cylinder 60 then moves through the line 63, back through the valve 62 and returns to the supply tank through the line 74. This reversal of the positions of the hydraulic cylinders 60, 61 imparts movement in reverse directions to the left-hand ends of the upper and lower runs 37, 38 of the closed loop 26 to impart clockwise movement to the sprocket 41 and thereby impart clockwise movement to the closed loop 27 and the sprocket 51 so that the bucket 25 moves from the dash-dot vertical line position shown in FIG. 1 to the solid line horizontal position.

After the injured workman has been removed or the bucket has been cleaned, as the case may be, the three-way valve 62 is then moved to the left in FIG. 3 so that the cylinder 60 is again returned to the normally inactive extended position while the cylinder 61 is returned to the normally inactive contracted position. Counter-clockwise movement is thus imparted to the sprockets 41 and 51 so that the bucket 25 is again returned to the vertical position.

The bucket rotation system of the present invention can be added to a conventional type of truck-supported aerial tower by a simple procedure of interposing hydraulic cylinders in the closed loop of flexible elongate material of the mechanical bucket leveling system. The bucket rotation system is then immediately available to move the bucket from the normal vertical position to a horizontal position. It is the usual practice to install the hydraulic cylinders in the closed loop of the mechanical leveling system at a convenient location behind the usual inspection plate 13' in the lower boom 13 so that they may be easily positioned for adjustment and the like. While the present hydraulic cylinders are illustrated as being mounted in the closed loops of a mechanical leveling system which includes cables and sprocket chain sections, it is to be understood that the bucket rotation system of the present invention can also be used with other types of mechanical bucket leveling systems presently in use in aerial towers and the like.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a truck supported aerial tower including a first boom section supported at one end for pivotal and rotational movement on said truck, a second boom section pivotally supported at one end to the other end of said first boom section, motive means for imparting selected movement to said first boom section relative to said truck and to said second boom section relative to said first boom section, a workman support bucket supported for pivotal movement on the other end of said second boom section, and a mechanical leveling system extending from said truck to said workman support bucket and including at least one closed loop of flexible elongate material extending along said first and second boom sections, said closed loop including adjacent runs movable in opposite directions upon movement of said boom sections to normally maintain said workman support bucket in a vertical position throughout the range of movement of said first and second boom sections, adjustment means in said closed loop for making minor adjustments of said workman support bucket relative to the vertical position, the combination therewith of a bucket rotation system including operator means interposed in said closed loop, said operator means being movable between active and inactive positions and independently of said minor adjustment means, said operator means normally being maintained in said inactive position to maintain said workman support bucket in the vertical position, and control means operatively connected to said operator means, said control means being operable to immediately move said operator means from said normal inactive position to said active position and to thereby impact sufficient movement in opposite directions to said adjacent runs independently of movement of said boom sections to immediately move said workman support bucket from the normal vertical position to a horizontal position to facilitate removal of an injured workman from said support bucket.

2. In an apparatus according to claim 1 wherein said operator means interposed in said closed loop comprises a first hydraulic cylinder interposed in one run and in a normally inactive position, a second hydraulic cylinder interposed in the other run and in a normally inactive position, and wherein said control means comprises a hydraulic system including a manually operable valve for moving said first and second hydraulic cylinders from said inactive positions to active positions wherein one of said hydraulic cylinders occupies an increased effective length of its run and the other hydraulic cylinder occupies a decreased effective length of its run.

3. In an apparatus according to claim 2 wherein said normally inactive position of said first hydraulic cylinder comprises an extended position, wherein said normally inactive position of said second hydraulic cylinder comprises a contracted position, and wherein said hydraulic control means moves said first hydraulic cylinder to an active contracted position and said second hydraulic cylinder to an active extended position.

4. In an apparatus according to claim 1 including first and second closed loops in said respective first and second boom sections, and wherein each of said closed loops includes a sprocket chain section at each end, a cable section extending along each run, length adjustment means positioned in each of said runs, a first sprocket supported in said first boom section and in a fixed position on said pivotal connection with said truck, said first sprocket being engaged by said sprocket chain section at one end of said first closed loop, rotatable sprocket means supported on the pivotal connection of said first and second boom sections, said rotatable sprocket means being engaged by said sprocket chain section at the other end of said first closed loop and by said sprocket chain section at one end of said second closed loop, a second sprocket supported on the pivotal connection between said workman support bucket and said second boom section and in a fixed position relative to said bucket, said second sprocket being engaged by said sprocket chain section at the other end of said second closed loop, and wherein said operator means is interposed in each run of said first closed loop.

* * * * *